United States Patent [19]

Fiedler

[11] 4,265,209

[45] May 5, 1981

[54] FUEL CONTROL AND INJECTION SYSTEM FOR I.C. ENGINES

[76] Inventor: Willy A. Fiedler, 12758 Leander Dr., Los Altos Hills, Calif. 94022

[21] Appl. No.: 5,359

[22] Filed: Jan. 19, 1979

[51] Int. Cl.[3] ..... F02M 41/00

[52] U.S. Cl. ..... 123/450; 123/43 S; 261/39 R; 261/51; 261/35

[58] Field of Search ..... 123/139 AW, 139 BG, 123/139 BC, 138; 261/39 R, 51, 35

[56] References Cited

U.S. PATENT DOCUMENTS

| | | | |
|---|---|---|---|
| 1,905,159 | 4/1933 | Davidson | 123/139 AW |
| 4,068,626 | 1/1978 | Fiedler | 123/30 D |
| 4,170,205 | 10/1979 | Fiedler | 123/139 AS |

*Primary Examiner*—Charles J. Myhre
*Assistant Examiner*—Magdalen Moy

[57] ABSTRACT

Intake air flowing through a controlling device turns a spring constrained rotor and an attached metering valve to control the fuel flow. The aerodynamically computed turn angle depends on air velocity and density and on vortices generated with vanes actuated with device-integral means responding to operational needs. The fuel is delivered to intake ports or to cylinders.

6 Claims, 2 Drawing Figures

FUEL CONTROL AND INJECTION SYSTEM FOR I.C. ENGINES

BACKGROUND OF THE INVENTION

The disclosure relates to fuel control and distribution with fluiddynamic and mechanical means shown in U.S. Pat. No. 4,068,626 and application Ser. No. 839,633, now U.S. Pat. No. 4,170,205. It differs in the means for computing air/fuel ratios and transfering fuel.

SUMMARY OF THE INVENTION

It is the main object of the invention to combine in one device the means to aerodynamically relate and accurately control the flows of air and fuel, changing their ratio in response to all operational needs with a minimum of external sensors, and to equally divide the metered fuel flow for distribution in the engine. Another object is the definition of compatible injection methods.

The flow controller houses, coaxially to its circular air duct, a rotor with multiple blades which are inclined to the air flow. Aerodynamic forces on the blades generate torque deflecting a spring which limits rotor motion, whereby the turn angle depends on geometry, dynamic air pressure and on the strength of vortis generated with vanes. One vane is cam-linked to the throttle and deflected for fuel enrichment at higher power levels and during idling, another vane is positioned with a bi-metal spring for enrichment during engine warm-up. Attached to the rotor is a metering valve controlling the fuel flow rate for injection into the engine manifold or releasing it in a continuous flow to injection valves in the intake ports or intermittently to valves in the cylinders.

DETAILED DESCRIPTION

One prerequisite for further reduction of consumption and emissions is accurate control of the fuel flow in relation to the throttle-controlled air flow for engine operation at lean limits. It is approached by computing the air-fuel ratios aerodynamically with a bladed rotor from the dynamic air pressure and from vorticities representing operational conditions generated with air vanes. A vane, deflected from its neutral position, generates lift on itself and an equivalent air down-wash. The lift moment around the rotor and duct axis equals the product of the affected air mass and its mean circular acceleration. The helix angle of the vortex increases linearly with the vane area and is independent of air density.

The rotor integrates the moments caused by all lift forces generated on the rotor blades. With increasing moments a free-spinning rotor increases its speed nullifying the sum of moments, while an elastically constrained rotor increases its turn angle, which becomes a measure of the needed fuel flow rate. The resulting air-fuel ratio varies as programmed for different power levels and engine temperatures.

Figure 1:
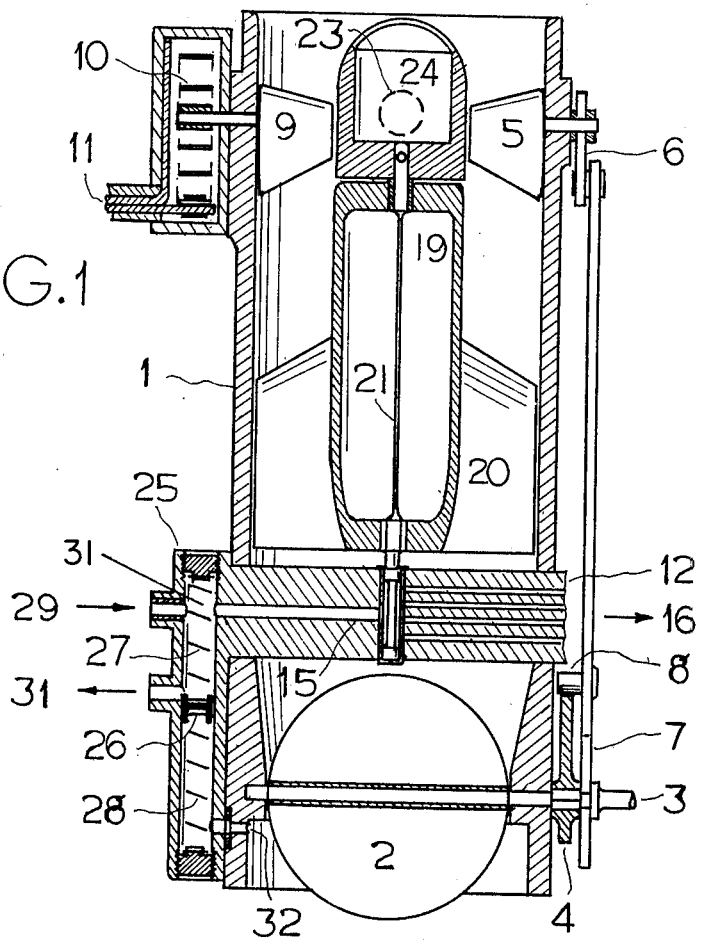
FIG. 1 is a semi-schematic view of an air-fuel flow controller in an internal combustion engine, intersecting the air flow between filter and engine manifold and the fuel flow from a tank pump to injection valves. Located in its air duct are two vanes, a rotor and a throttle with the plate shown open. Fuel elements include a pressure regulator and a metering valve in a crossarm, for clarity shown in one plane with the vanes.

FIG. 1 shows the controller. Intake air flowing through the annular duct of body 1 is controlled by throttle 2 with shaft 3, turned by the engine operator. Cam 4, shaped to enrich the air-fuel ratio at higher power levels and during idling and in-between enforce operation at leaner than stoichiometric ratios, deflects vane 5 with lever 6 and fork 7 with button 8. Vane 9 is aerodynamically balanced and positioned by bi-metal spring 10 with heat conducter 11 connected to the engine block and deflecting in relation to temperature for enrichment, especially during cold starts, and for leaning-out of the air-fuel ratio.

Figure 2:
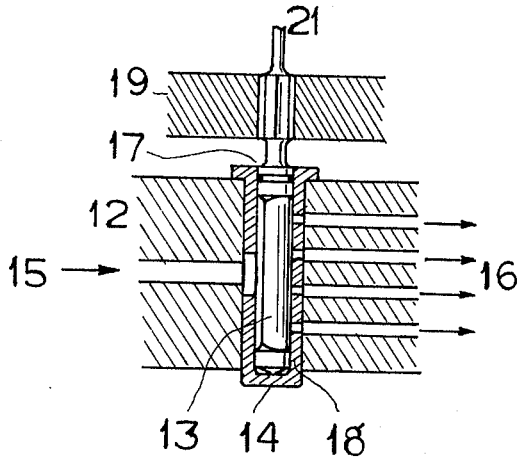
FIG. 2 is an enlarged sectional view of the metering valve.

Body 1 supports crossarm 12. Better shown in FIG. 2 are its elements: Eccenter 13, coaxial to sleeve 14, controls with at least one near-spiral surface the fuel flow from inlet 15 into outlets 16 and corrects the non-linearity of aerodynamic forces; the control surface remains clear of sleeve 14 so that friction is limited to bearings 17 and 18. Eccenter 13 is attached to rotor 19 with inclined blades 20 and to torsion spring 21. FIG. 1 shows how the fore end of spring 21 forms a bearing for rotor 19 and is attached to hub 22, supported by arm 23 and faired with cap 24. Low inertia of rotor 19 assures fast response to air flow changes; its rotation is limited by stops, not shown here, for maximum spring deflection and for the adjustment of idling speed. Regulator 25, with floating piston 26 and springs 27 and 28 receives fuel through a filter from a constant pressure tank pump through joint 29, releases it at reduced pressure through drilling 30 into crossarm 12 and returns surplus fuel through joint 31 to a fuel tank. Fuel pressure and return are regulated by piston 26 responding to manifold pressure changes sensed through drilling 32. Outlets 16 are with fuel lines connected at the engine intake ports with continuous flow injection valves.

In a second fuel delivery system the controller is combined with intermittant injection means spraying fuel increments during intake strokes without command into cylinders, preferably with prechambers. In engines with at least four cylinders the fuel flows continuously into the controller metering valve, while cyclic outflows alternate between its outlets.

In a third fuel delivery system the controller is equipped with an electrical sensor instead of the metering valve, measuring rotor torque by sensing spring displacement or strain. Electric/mechanical control means correct for the non-linearities of aerodynamic forces, compute the rate of flow and distribute the fuel equally between fuel injection valves.

I claim:

1. An arrangement for providing air and fuel to at least one cylinder in an internal combustion engine comprising in combination a fuel tank, a tank pump for delivering fuel under pressure, a controller of air and fuel flow rates, including a duct for passing air to said engine, a throttle for controlling the air flow through said duct, vanes movably mounted in said duct for generating air vortices in the air flow, means for relating the movement of the first of said vanes to the movement of said throttle for varying the air-fuel flow ratio, means for positioning the second of said vanes in relation to engine temperature for varying the air-fuel flow ratio, a rotor with at least one blade, inclined to the air flow direction, for aerodynamically developing torque around its axis in dependence of air velocity, density and vorticity, spring means elastically restraining said rotor and deflecting to counter torque applied by said rotor, metering means governed by said rotor for controlling the rate of continuous fuel flow and for dividing it equally if said engine has more than one cylinder, a regulator for maintaining near-constant differential pressure between the fuel supplied by said tank pump and the air behind said throttle while returning surplus fuel to said fuel tank;

means for transfering fuel from said controller to said engine, with said cylinder having an intake port, continuous injection means for releasing fuel into said intake port while maintaining pressure, a fuel line connecting said metering means with said continuous injection means.

2. The arrangement of claim 1, wherein said air duct and said rotor are coaxial and the number of said blades large for miminizing torque differences from flow variations in the wake of said vanes and thereby the distance between said vanes and said rotor.

3. The arrangement of claim 1, wherein said metering means include a cylindrical well with at least one fuel inlet and the number of outlets corresponding to the number of said cylinders, an eccenter, attached to and turning with said rotor, with at least one control surface near-spirally shaped to compensate for the non-linearities of aerodynamic torque for metering and equalizing the rate of fuel flow into said outlets of said well and for keeping said control surface off said well to avoid friction and wear.

4. The arrangement of claim 1, wherein said means for positioning the second of said vanes in relation to engine temperature include bimetal means in an insulating enclosure on said duct, means for connecting said bimetal means with said vane, heat conducting means connecting said engine with said bimetal means, said means insulated from ambient air and flexible to ease installation.

5. An arrangement for providing air and fuel to at least one cylinder in an internal combustion engine comprising in combination a fuel tank a tank pump for delivering fuel under pressure, a controller of air and fuel flow rates, including a duct for passing air to said engine, a throttle for controlling the air flow through said duct, vanes movably mounted in said duct for generating air vortices in the air flow, means for relating the movement of the first of said vanes to the movement of said throttle for varying the air-fuel flow ratio, means for positioning the second of said vanes in relation to engine temperature for varying the air-fuel flow ratio, a rotor with at least one blade, inclined to the air flow direction, for aerodynamically developing torque around its axis in dependence of air velocity, density and vorticity, spring means elastically restraining said rotor and deflecting to counter torque applied by said rotor, metering means governed by said rotor for controlling the rate of continuous fuel flow and for dividing it equally if said engine has more than one cylinder, a regulator for maintaining near-constant differential pressure between the fuel supplied by said tank pump and the air behind said throttle while returning surplus fuel to said fuel tank;

means for transfering fuel from said controller to said engine with said cylinder having intermittant injection means including a valve for admitting fuel in increments without timing commands in response to cyclic pressure differentials between said fuel and said cylinder and for preventing back flow from said cylinder, a nozzle for dispersing fuel in said cylinder, a fuel line connecting said metering means with said intermittant injection means.

6. An arrangement for providing air and fuel to at least one cylinder in an internal combustion engine comprising in combination a fuel tank, a tank pump for delivering fuel under pressure, a controller of air and fuel flow rates, including a duct for passing air to said engine, a throttle for controlling the air flow through said duct, vanes movably mounted in said duct for generating air vortices in the air flow, means for relating the movement of the first of said vanes to the movement of said throttle for varying the air-fuel flow ratio, means for positioning the second of said vanes in relation to engine temperature for varying the air-fuel ratio, a rotor with at least one blade, inclined to the air flow direction, for aerodynamically developing torque around its axis in dependence of air velocity, density and vorticity, spring means elastically restraining said rotor and deflecting to counter torque applied by said rotor, torque sensing means for electrically measuring the aerodynamically developed torque or the turn angle of said rotor and correcting for non-linearities;

engine speed sensing means, electronic computing means for determining volume and frequency of fuel increments from the output of said torque sensing means and said engine speed sensing means, intermittant injection means for electromagnetically releasing and dispersing fuel on command of said computing means, a fuel line connecting said intermittant injection means with said tank pump.

* * * * *